US005102035A

United States Patent [19]

Cecchi

[11] Patent Number: 5,102,035

[45] Date of Patent: Apr. 7, 1992

[54] ENVELOPE WITH IDENTIFICATION TAB

[76] Inventor: Bryan W. Cecchi, 53 Steele Rd., New Hartford, Conn. 06057

[21] Appl. No.: 512,193

[22] Filed: Apr. 20, 1990

[51] Int. Cl.[5] ..... B65D 27/00; B65D 27/06

[52] U.S. Cl. ..... 229/70; 229/301; 229/84

[58] Field of Search ..... 229/70, 73, 74, 84

[56] References Cited

U.S. PATENT DOCUMENTS

| | | | |
|---|---|---|---|
| 366,054 | 7/1887 | Whitney et al. | 229/74 |
| 1,032,648 | 7/1912 | Berwick | 229/70 X |
| 1,044,123 | 11/1912 | Berwick | 229/70 X |
| 2,108,451 | 2/1938 | Selezneff | 229/84 |
| 2,303,296 | 11/1942 | Avery | 229/70 X |
| 2,347,075 | 4/1944 | Berkowitz | 229/70 |
| 3,302,861 | 2/1967 | Hiersteiner | 229/70 |
| 3,356,286 | 12/1967 | Greason | 229/70 |
| 3,368,741 | 2/1968 | Mercur | 229/70 |
| 3,472,444 | 10/1969 | Aliff, Jr. et al. | 229/70 |
| 3,537,637 | 11/1970 | Hiersteiner | 229/70 |
| 3,537,638 | 11/1970 | Hyman | 229/70 |
| 4,047,661 | 9/1977 | Klein | 229/70 |
| 4,310,117 | 1/1982 | Gullett | 229/70 X |

*Primary Examiner*—Stephen Marcus
*Assistant Examiner*—Jes F. Pascua
*Attorney, Agent, or Firm*—Beveridge, DeGrandi & Weilacher

[57] ABSTRACT

An envelope suitable for photo processing work is formed of front and rear panels connected together to form a pouch. The rear panel has a closure flap which is movable from an upright position to a closed position where it is folded down over the pouch. The front panel has a flap which is movable from an upright position to a position where it is tucked into the pouch to prevent objects from falling from the pouch. The flap on the front panel has an identification tab which is insertable through a slot formed in the rear panel and projects up for convenient access and visibility when the closure flap is in its closed position.

15 Claims, 2 Drawing Sheets

ENVELOPE WITH IDENTIFICATION TAB

BACKGROUND OF THE INVENTION

This invention relates to a novel envelope construction, which, although suited to various purposes, is particularly adapted for use in connection with photo processing.

In the photo processing industry, two envelopes are customarily used for each order. The customer's film is placed in an outer envelope which has a work order printed on its front panel. The film and outer envelope go to the laboratory where the film is developed and prints are made. At the lab, the prints and the negatives are placed in an inner envelope, often called a "wallet," which is then put into the outer envelope and returned to the pickup location.

The envelope according to the invention makes it possible to handle a photographic order effectively using only a single envelope, and it also provides an envelope with important novel features which are desirable to counter employees, lab personnel, and customers. For example, the envelope has a tab which holds the film, negatives and/or prints in the pouch to reduce the risk of inadvertent loss. The tab provides a convenient identification system which enables counter employees to identify the customer, and enables the customer to identify the contents of the envelope in his or her home. The dimensions of the envelope make it convenient to manipulate, and it can be designed to handle diverse objects such as film cartridges, negatives, and prints ranging from the smallest size up to 5"×7". A work order form is disposed on the envelope in a way which is convenient to lab personnel, counter employees and others who need to refer to it. Gussets are provided to enable the product to handle a variety of objects or thicknesses.

SUMMARY OF THE INVENTION

According to the invention, an envelope has front and rear panels with lower pouch-forming portions connected together to form a pouch. A closure flap is connected by a fold line to the pouch-forming portion of the rear panel, and this closure flap is movable from an open position where it extends up from the pouch to a closed position where it folds down over the pouch. A slot is formed in the rear panel. The front panel has an identification tab which extends above the slot and above the fold line in the rear panel. This identification tab is insertable through the slot so that it projects above the fold line for convenient visibility and access when the closure flap is in its closed position.

Preferably, the identification tab has one surface provided with means for designating an area for writing a description of in the envelope's contents, and an opposite surface designating for writing the customer's name.

According to a preferred embodiment of the invention, the identification tab is part of a flap which is connected by a fold line to the pouch-forming portion of the front panel. This flap is movable to a position where it extends into the pouch to retain objects in the envelope. To assure such retention, the front panel has an intermediate section, located between the tab and the fold line, which has a width greater than that of the identification tab.

A work order or similar instruction means is provided on the closure flap so that the instructions are upright and face forwardly when the closure flap is in its open position. The tab-receiving slot preferably is at least ⅛ inch wide, and it is located at or below the fold line in the rear panel so that, when the identification tab extends through the slot, the closure flap can be raised and lowered without moving the identification tab. For photographic purposes it is desirable to provide the pouch with gusseted sides and dimensions which are at least 5"×7". Neither the front flap nor the closure flap are provided with an adhesive.

The invention may take many different forms, a preferred version of which is shown herein for exemplary purposes.

DETAILED DESCRIPTION

Figure 1:
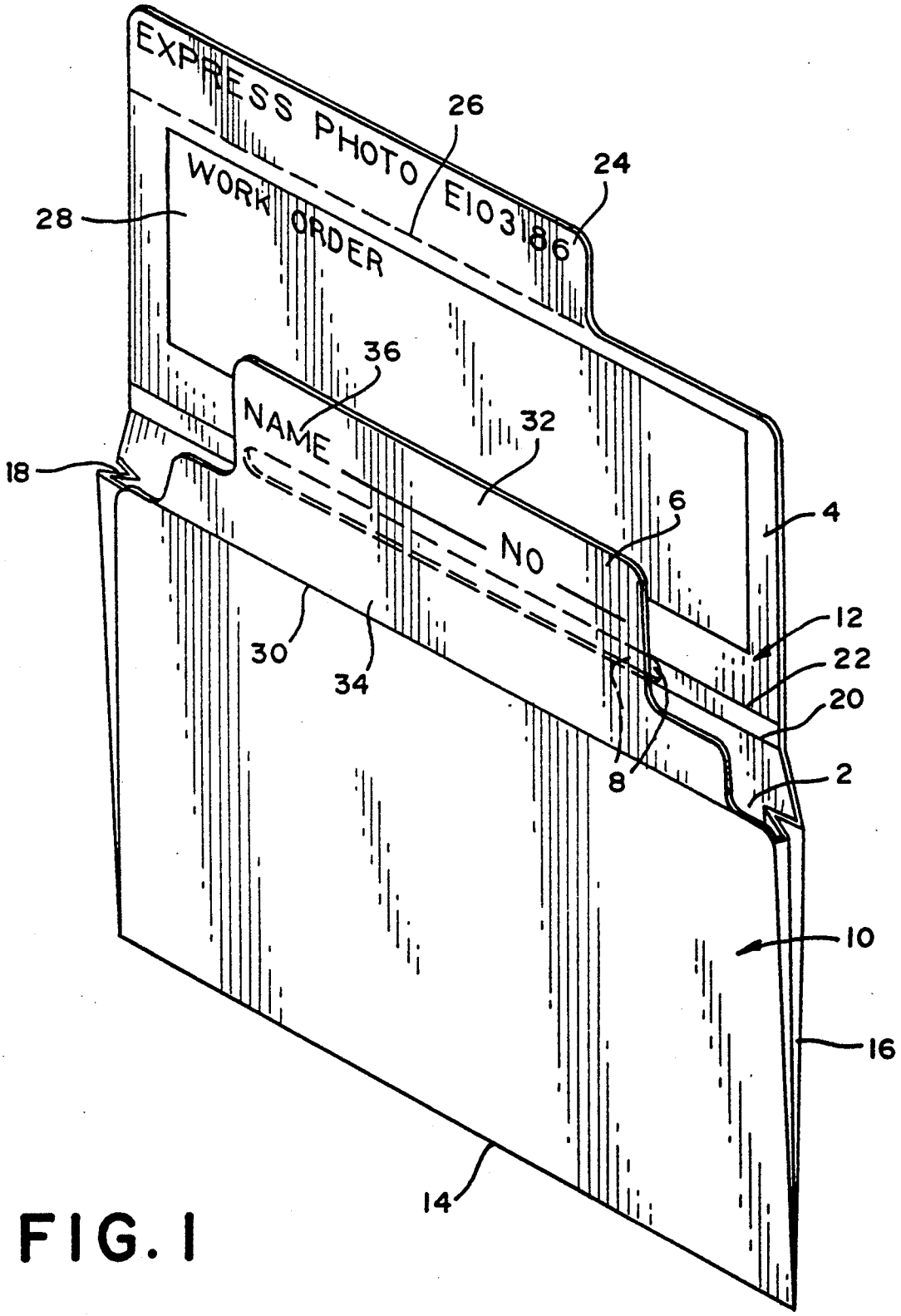
FIG. 1 is a perspective view showing the envelope in its initial position with both flaps in their upright positions.

As shown in FIG. 1, the envelope has a pouch 2 for holding objects such as photographic films and prints, a closure flap 4 which is foldable down over the pouch, and a retainer/identifier flap 6 which can either be folded down into the pouch or inserted through a slot 8 formed in the rear panel of the envelope.

The envelope is formed of a blank of paper or other suitable sheet material which has a front panel 10 connected to a rear panel 12 by a fold line 14. The sides of the panels 10 and 12 are connected together by gussets 16 and 18 to form the pouch 2. The closure flap 4 is connected by fold lines 20 and 22 to the pouch-forming lower portion of the rear panel 12. These fold lines are aligned with the upper and lower edges of the slot 8. A claim check 24 is detachably connected to the upper part of flap 4 by a weakened, tearable perforated line 26.

To provide instructions to persons who work on the envelope contents, a work order form 28 is printed on the flap 4, oriented so it is upright and faces forwardly when the flap 4 is in its open position. In the photographic field, this form may have preprinted indicia which can be checked or encircled to specify the date the order is received, the film size, the type of enclosures received from the customer (negatives, slides, prints, etc.), the size of prints or enlargements to be produced in the lab, the quantity of prints or enlargements, and the promised delivery date. An order number corresponding to the claim check number is also printed on the work order.

Figure 2:
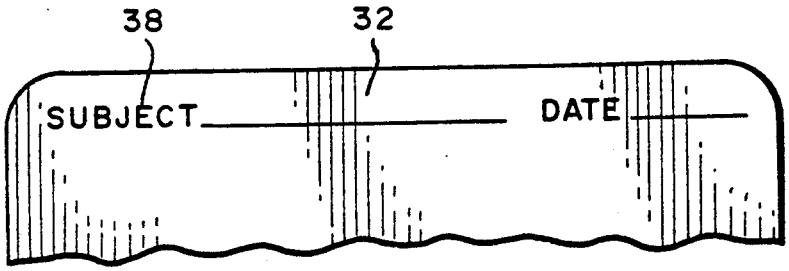
FIG. 2 is a view of the rear surface of the identification tab.

The front flap 6 is attached to the pouch-forming lower portion of the front panel 10 by a fold line 30. The upper part of flap 6 is an identification tab 32 which has a width less than the length of slot 8. Between the tab 32 and the fold line 30, the flap 6 has an intermediate section 34 which has a width less than that of the pouch 2 and greater than that of the tab 32. As shown in FIG. 1, the front surface of the identification tab 32 is printed with a legend 36 designating the area for writing the customer's name. On the opposite side of the tab 30, shown in FIG. 2, there is a legend 38 for designating the area where the customer may later write a short description of the envelope's contents.

Figure 3:
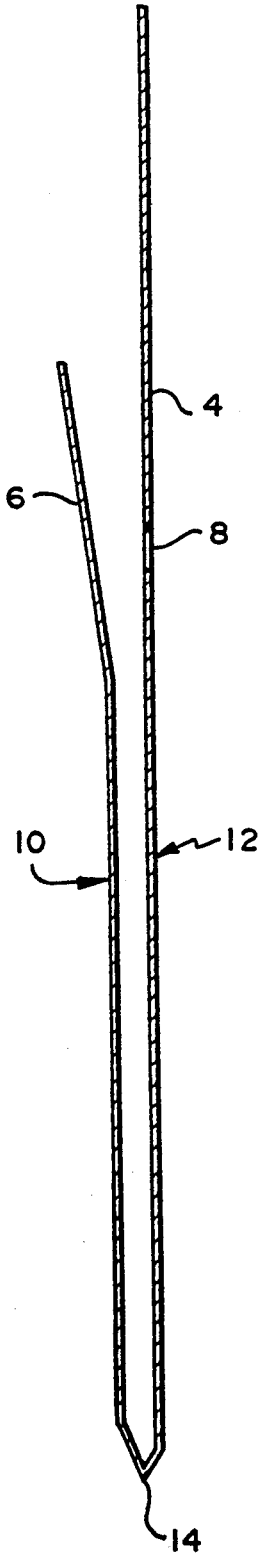
FIG. 3 is a diagrammatic sectional view through the envelope when in the position shown in FIG. 1.
Figure 4:
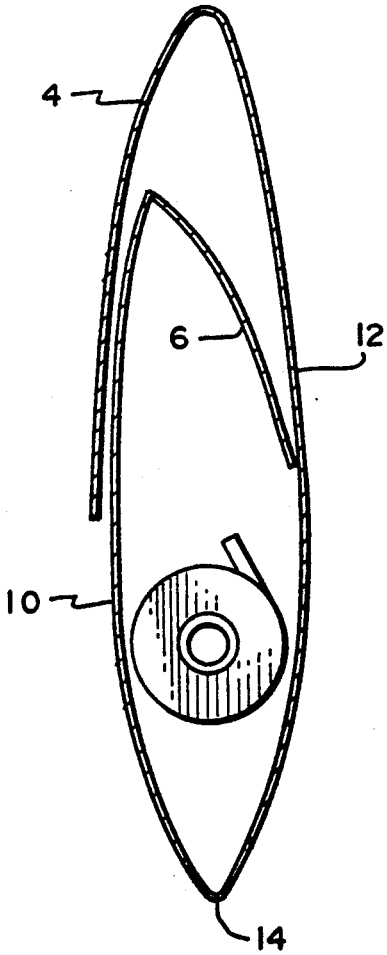
FIG. 4 is a diagrammatic sectional view showing the envelope when the front flap is inserted into the pouch for retention purposes and the rear flap is in its closed position.

The front flap 6 is movable from its upright position shown in FIGS. 1 and 3 to the position shown in FIG. 4 where it extends into the pouch 2. Since the intermediate portion 34 of the flap is almost as wide as the pouch, the flap 6 in this position effectively retains all objects securely in the pouch.

When the closure flap is in the open position illustrated in FIG. 3, the upper edge of the slot 8 is above the pouch 2 and below the upper edge of the identification tab 32.

Figure 5:
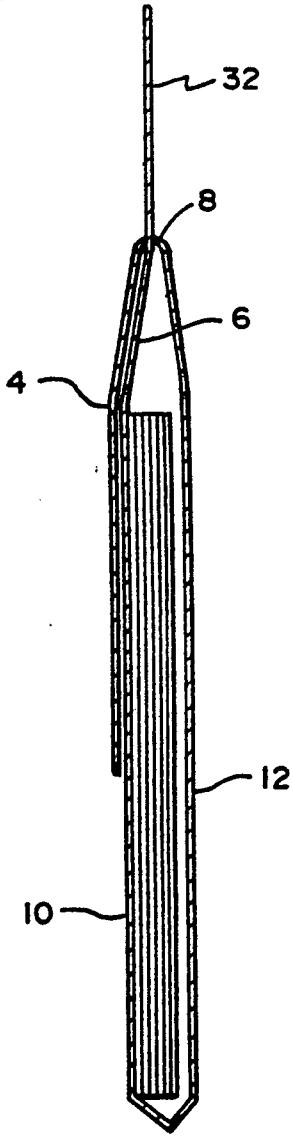
FIG. 5 is a diagrammatic sectional view showing the envelope of the invention where the identification tab is extending upwardly for convenient visibility and access.

The identification tab portion 32 of the retainer flap 6 is also insertable through the slot 8 as shown in FIG. 5. In this position, the tab 32 extends above the slot 8 and above the fold lines 20 and 22 for convenient visibility and access when the closure flap 4 is in its closed position. Because the slot 8 is at or below the fold lines 20, 22, the closure flap 4 can be raised or lowered to inspect the work order 28 without moving the identification tab 32 which extends through the slot.

To facilitate insertion of the tab 32 through the slot, the slot 8 should be at least ⅛ inch wide. For use in the photo industry, the panels 10 and 12 should be at least seven inches wide, and the fold line 20 in the rear panel should be at least five inches above the bottom of the pouch. With these dimensions, the envelope can hold prints or enlargements up to a 5"×7" size.

In the course of normal use in the photographic field, a supply of the envelopes is kept at the retail counter. When a customer brings in film, the counter employee marks the work order 28 with suitable instructions and writes the customer's name and/or number on the front of the identification tab 32. The claim check 24 is torn from the envelope and given to the customer; the film is placed inside the pouch 2; and, the front flap is folded into the pouch as shown in FIG. 4 where it acts as a retainer flap in the respect that the intermediate portion 34 of flap 6 will prevent the film from falling out of the envelope. For additional security and compactness, the rear flap 4 is folded to its closed position as shown in FIG. 4. The envelope is then sent to the lab. At the lab, the flaps 4 and 6 are returned to their upright positions shown in FIGS. 1 and 3, and the film is removed from the pouch 2. The film is developed and prints are made. During this processing work, the film remains with the work order where it is clipped thereto in accordance with existing photographic laboratory procedures. When the envelope is hanging from a clip, the laboratory personnel are able to see the work order instructions conveniently. When the processing is completed, the prints and negatives are placed in the pouch, and the tab 32 is inserted through the slot 8 to ensure that the contents will remain inside the pouch 2. The rear flap 4 is then folded down to its closed position. As shown in FIG. 5, the identification/retainer flaps 6 projects above the pouch. This, in effect, provides an index tab which is readily visible to laboratory and counter personnel who can easily sort the envelopes by customer name or any other suitable system.

When the customer picks up the order at the counter, it is convenient to verify the work order simply by raising the flap 4 without disturbing the contents of the envelope. Later, after the customer has taken the work home and inspected the prints, he can store them with other envelopes of this type, arranging the envelopes so that the rear surfaces of the tabs 32 are visible, enabling the customer easily to select an envelope based on the subject matter or date indicated on the identification tab 32.

Although only one embodiment of the invention has been disclosed, persons familiar with the art will realize that it may take many other forms. Since the invention embraces variations, modifications, and improvements, it is emphasized that the invention is not limited to the disclosed embodiment but includes a wide variety of envelopes falling within the spirit of the following claims.

What is claimed is:

1. An envelope, comprising, a front panel and a rear panel having pouch-forming portions which are connected together to form a pouch, said rear panel having a closure flap which is connected by a fold line to the pouch-forming portion of said rear panel, said closure flap being movable from an open position where it extends up from the pouch to a closed position where it is folded down over the pouch, a slot formed in said rear panel, said front panel having an identification tab which has an upper edge which extends above said slot and above said fold line, said slot having an upper edge which, when the closure flap is in said open position, is above the pouch and below the upper edge of the tab, said identification tab being insertable through said slot so that said identification tab projects above the fold line (a) for convenient visibility and access when said closure flap is in its closed position, and (b) for retaining objects in the pouch when said closure flap is in its open position.

2. An envelope according to claim 1 wherein the front panel has a fold line between the identification tab and the pouch-forming portion of the front panel, whereby the identification tab is movable from an upright position to a folded position where it extends into said pouch.

3. An envelope according to claim 1 having a claim check detachably connected to one of said panels by a weakened line.

4. An envelope according to claim 1 wherein the slot has a width of at least about ⅛ inch.

5. An envelope according to claim 1 wherein the front and rear panels are at least seven inches wide, and the fold line in the rear panel is at least five inches above the bottom of the pouch.

6. An envelope according to claim 1 wherein the pouch has gusseted sides.

7. An envelope according to claim 1 wherein the closure flap is provided with instruction means for providing instructions to persons who work on objects in the envelope.

8. An envelope according to claim 7 wherein the instruction means is upright and faces forwardly when the closure flap is in its open position.

9. An envelope according to claim 8 wherein said slot is at the fold line of the rear panel whereby, when the identification tab extends through the slot, the closure flap can be raised and lowered without moving the identification tab.

10. An envelope according to claim 1 wherein said slot is at the fold line of the rear panel whereby, when the identification tab extends through the slot, the closure flap can be raised and lowered without moving the identification tab.

11. An envelope according to claim 1 wherein said front panel includes a retainer flap which is connected by a fold line to the pouch-forming portion of said front panel, said retainer flap being movable to a position where it extends into the pouch to retain objects in the envelope, said identification tab being a portion of the retainer flap.

12. An envelope according to claim 1 wherein the front panel has an intermediate section between the identification tab and the fold line of the front panel, said intermediate section having a width which is less than that of the pouch and greater than that of the identification tab.

13. An envelope according to claim 12 wherein the identification tab has an opposite surface provided with means for designating an area for writing a customer name.

14. An envelope according to claim 1 wherein the identification tab has a surface provided with means for designating an area thereon for writing a customer name.

15. An envelope according to claim 1 wherein the identification tab has a surface provided with means for designating an area thereon for writing a description of objects in the envelope.

* * * * *